US010633896B1

(12) United States Patent
Barba

(10) Patent No.: US 10,633,896 B1
(45) Date of Patent: Apr. 28, 2020

(54) THEFT RESISTANT LOCKING DEVICE FOR A ROLL-UP DOOR

(71) Applicant: Raul Barba, Colfax, CA (US)

(72) Inventor: Raul Barba, Colfax, CA (US)

( * ) Notice: Subject to any disclaimer, the term of this patent is extended or adjusted under 35 U.S.C. 154(b) by 938 days.

(21) Appl. No.: 15/073,025

(22) Filed: Mar. 17, 2016

Related U.S. Application Data

(60) Provisional application No. 62/133,996, filed on Mar. 17, 2015.

(51) Int. Cl.
*E05B 83/02* (2014.01)
*E05B 65/00* (2006.01)
*E05B 85/24* (2014.01)

(52) U.S. Cl.
CPC ..... *E05B 85/24* (2013.01); *E05B 65/0021* (2013.01); *E05B 83/02* (2013.01); *Y10T 292/0937* (2015.04); *Y10T 292/1039* (2015.04)

(58) Field of Classification Search
CPC ..... E05B 65/0021; E05B 83/02; E05B 85/24; Y10T 292/1039; Y10T 292/104; Y10T 292/1041; Y10T 292/0937; Y10T 292/0938; Y10T 292/0941; Y10T 292/32
See application file for complete search history.

(56) References Cited

U.S. PATENT DOCUMENTS 1,504,967 A * 8/1924 Orendorff ..... E05B 85/24 292/129
3,439,948 A * 4/1969 Smith ..... E05B 83/16 292/216
3,572,066 A * 3/1971 Peters ..... E05B 83/16 292/201
3,578,368 A * 5/1971 Dupuis ..... B41J 29/387 292/216
3,642,314 A * 2/1972 Smith ..... E05B 13/002 292/134
3,705,505 A * 12/1972 Landow ..... E05B 65/0021 292/216
3,893,722 A 7/1975 Galbreath et al.
3,958,821 A * 5/1976 Scalera ..... E05B 13/002 292/97
3,989,289 A * 11/1976 Ringe ..... E05B 83/10 292/241
5,688,004 A * 11/1997 Karge ..... E05B 47/0012 292/201
7,066,500 B2 * 6/2006 Haber ..... E05B 17/2038 292/106
7,861,976 B2 * 1/2011 Holemans ..... B63B 21/08 244/119
(Continued)

OTHER PUBLICATIONS

Reference from Youtube Website at: https://www.youtube.com/watch?v=I8_Gpj1Q-rw with a publication date of Jan. 29, 2013 Babaco Truk Lok II Roll Up Doors.

*Primary Examiner* — Carlos Lugo
(74) *Attorney, Agent, or Firm* — John P. Costello; Costello Law Corp.

(57) ABSTRACT

The invention is a locking device for securing roll-up doors on tractor trailers and other cargo vehicles. The working parts of the invention are enclosed inside a housing and the invention employs a dual catch-pin system which allows the door to be locked shut with minimal play between the bottom of the door and loading deck of the cargo vehicle. This, the invention is resistant to attempts to slide pry bars or jacks under the door in force breach attempts.

9 Claims, 7 Drawing Sheets

(56) References Cited

U.S. PATENT DOCUMENTS 8,336,929 B2 * 12/2012 Halliwell ..... E05B 15/021
292/216
8,876,171 B2 * 11/2014 Schendel ..... E05B 41/00
292/116
8,931,813 B2 * 1/2015 Juga ..... E05B 13/004
292/194

* cited by examiner

THEFT RESISTANT LOCKING DEVICE FOR A ROLL-UP DOOR

1. RELATED APPLICATIONS

This application claims the benefit of U.S. Provisional Patent Application No. 62/133,996, filed on Mar. 17, 2015

2. TECHNICAL FIELD

This invention relates to locking devices for securing doors and more specifically to a locking device for securing roll-up doors on cargo vehicles.

3. BACKGROUND

On road theft from tractor-trailer rigs and other cargo vehicles has been an ongoing problem. Tractor-trailer rigs present tempting targets to criminals due to the large quantity of high-value cargo they contain. A popular point of access on a trailer is through the rear roll-up doors, which have locks that are often easily breached or removed. One such easily breached lock type is the Truk-Lok II made by Babaco Alarm Systems, Inc. This type of lock is ubiquitous and a common method of breaching this lock is to slide a jacking device beneath the roll up door and apply upward force with the jack until the lock breaks at its failure points.

U.S. Pat. No. 3,893,722 issued to Galbreath et al. discloses a lock assembly wherein a hand lever operates an arcuate latch hook which engages a catch pin. The hand lever is elongate and spans across a distance to a separate key-lock assembly which locks the lever in place. A drawback to this design is that the hand lever can be sawed in half, thus freeing the hand lever from the lock assembly to allow the cargo door to be opened. Other designs merely padlock the hand lever in place; however these designs are easily breached by defeating the padlock.

Therefore a need exists for a locking device for roll-up doors on tractor-trailer rigs or other cargo vehicles which can resist forcible breaches from jacks, crow-bars or other force application tools placed beneath a roll-up door. A need further exists for a locking device which cannot be breached by merely freeing the hand lever of a locking device.

The foregoing reflects the state of the art of which the inventor is aware, and is tendered with a view toward discharging the inventor's acknowledged duty of candor, which may be pertinent to the patentability of the present invention. It is respectfully stipulated, however, that the foregoing discussion does not teach or render obvious, singly or when considered in combination, the inventor's claimed invention.

SUMMARY OF THE INVENTION

The invention is a locking device for securing roll-up doors on tractor trailers and other cargo vehicles. The working parts of the invention are enclosed inside of a housing and the invention employs a twin catch-pin system which allows the door to be locked shut with minimal play between the bottom of the door and trailer deck. By gathering up the play between the door bottom and trailer deck, the invention is resistant to attempts to slide pry bars or jacks under the door in force breach attempts. Moreover, when the locking device achieves a closed and locked position, attempts to open the locking device by forcing the hand lever are thwarted.

When the invention is placed in an open position, it is designed to remain in the open position until the door is shut again. It is also designed to achieve the closed and locked position when the door is shut and the catch arm contacts a first upper catch pin, thus causing an arcuate latch hook to release and engage around a second lower catch pin. When the door is lowered so the catch arm contacts the upper catch pin, the remaining working parts of the locking device are set in motion such that the door closes and locks by itself. If a user desires to open the door, the device must be unlocked and a hand lever rotated to an open position, which resets the locking device into an open position awaiting the next closing of the door.

It is an object of the invention to provide a locking device which affords minimal play between the bottom of a roll-up door and the loading deck of a cargo vehicle.

It is another object of the invention to provide a locking device which automatically closes into a locked position and is resistant to being opened by forcing the hand lever.

Further objects and advantages of the invention will be brought out in the following portions of the specification, wherein the detailed description is for the purpose of fully disclosing the preferred embodiments of the invention, without placing limitations thereon.

BRIEF DESCRIPTION OF THE DRAWINGS

The invention will be more fully understood by reference to the following drawings which are for illustrative purposes only.

DETAILED DESCRIPTION OF THE PREFERRED EMBODIMENTS

Figure 1:
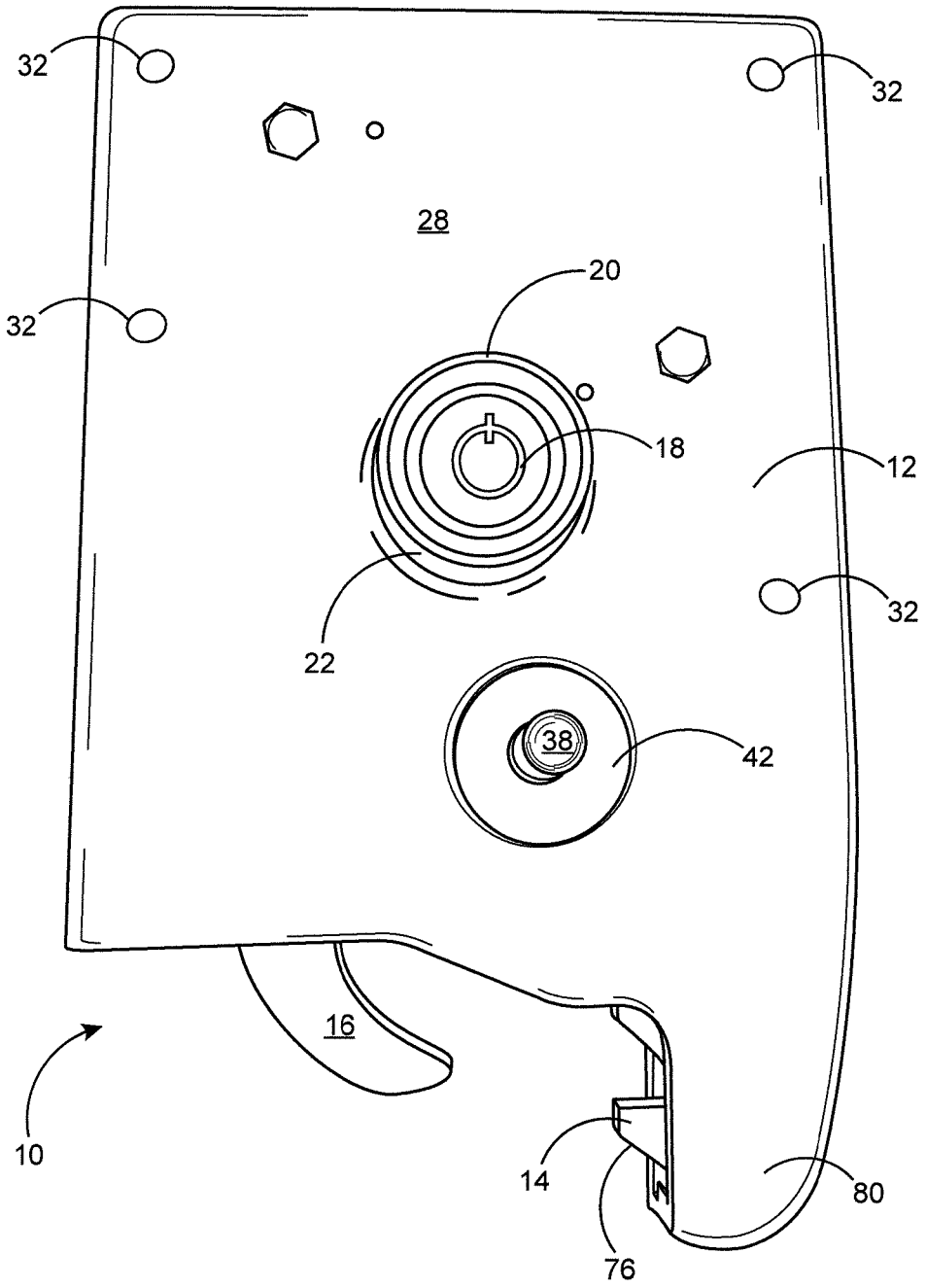
FIG. 1 is a front perspective view of the locking device of the present invention.
Figure 2:
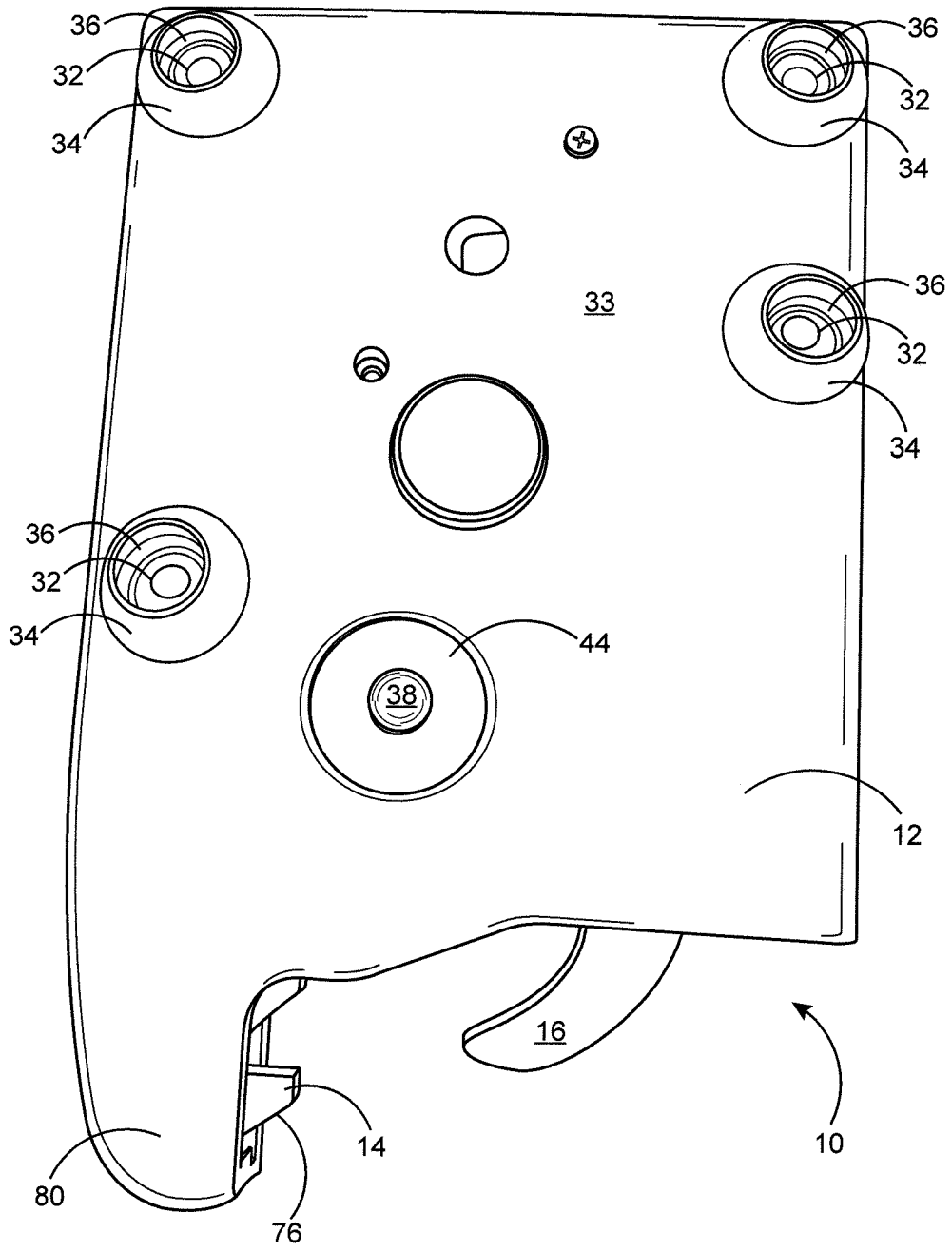
FIG. 2 is rear perspective view of the locking device of the present invention.

The exterior front and rear views of the inventive locking device 10 is shown in FIGS. 1 and 2, respectively. The locking device 10 is comprised of a housing 12 which retains all of the internal working parts of the locking device. In this view, the only internal working parts visible are the bottom of the catch arm 14 and the arcuate latch hook 16. A key lock 18 is mounted in lock retainer 20 on the housing 12. The lock retainer 20 mounts through a roll-up door 24 on a cargo vehicle 54 (See FIGS. 4A and 4B), and has a sidewall 22 of a height sufficient for protruding through a roll-up door 24 so that the key lock 18 mounts relatively flush and is accessible from the exterior side 26 of a roll-up door 24. The front face 28 of the housing 12 rests against the interior side 25 of a roll up door 24 and is retained on the door by a plurality of bolts 30 which penetrate the door 24 and housing 12 at bolt holes 32. Bolts 30 are preferably of an inaccessible variety such as round-head bolts. The rear face 33 of housing 12 is shown in FIG. 2, and shows nut keepers 34, which have a round cavity 36 for placing nuts (not shown) in perfect alignment with bolt holes 32 so that bolts 30 can easily engage nuts for tightening and thereby retaining the locking device 10 on the interior side 25 of a roll-up door 24. An axle 38 which attaches to arcuate latch hook 16 is retained in roller bearings 40 which are mounted in bearing races 42, 44 on the front face 28 and rear face 33 of housing 12 respectively. Latch hook 16 is joined to axle 38 and rotates in the direction that axle 38 rotates. On the front face 28 of the housing 12, axle 38 is a length sufficient to protrude through a roll-up door 24 and attach a hand lever 46. Articulating the hand lever 46 rotates axle 38 and engages and disengages arcuate latch hook 16 with lower catch pin 74 of catch assembly 50.

Figure 3A:
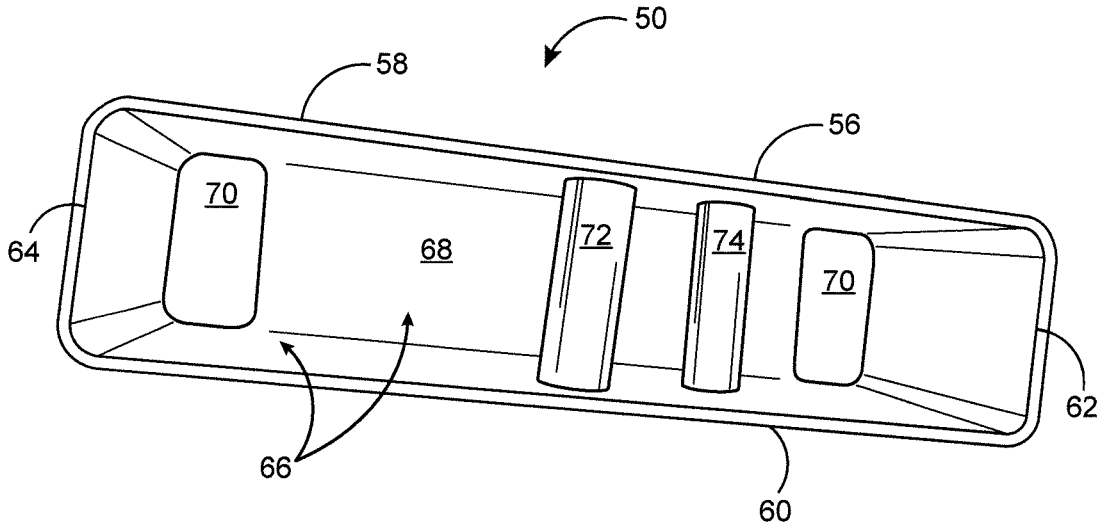
FIG. 3A is a plan view of the catch assembly of the locking device of the present invention.
Figure 3B:
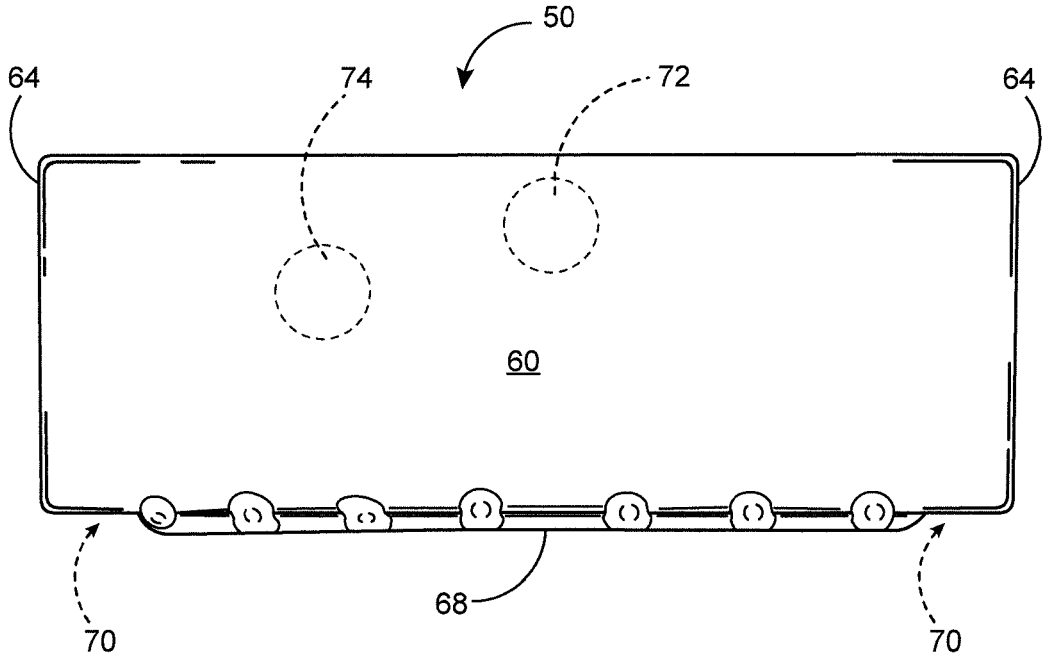
FIG. 3B is a perspective view of the catch assembly, with upper and lower catch pins shown in phantom.

The catch assembly 50 is shown in FIGS. 3A-3B, the catch assembly 50 mounts flushly with a loading deck 52 of a cargo vehicle 54, and is attached to the loading deck 52 by welding. Also, while a vehicle loading deck application is shown, in FIGS. 4A and 4B, catch assembly 50 could be mounted flushly in the floor of a storage unit, warehouse, or other structure employing a roll-up door. The catch assembly 50 is positioned beneath a roll-up door 24 in the loading deck 52 to lockingly engage the locking device 10 that is attached to the interior side 25 of a roll-up door 24. The catch assembly 50 is comprised of an elongated, substantially rectangular casing 56 having a pair of sidewalls 58 and 60 and a pair of end walls 62 and 64. The sidewalls 58, 60 and the end walls 62, 64 define a catch chamber 66 which preferably opens upwardly to receive the latch hook 16 and catch arm 14 and opens downwardly for drainage. A floor portion 68 borders the downward openings 70 and provides structural integrity. Catch assembly 50 employs two catch pins mounted in the catch assembly at differing heights. As shown in the Figures, an upper catch pin 72 and a lower catch pin 74 are mounted between sidewalls 58, 60.

Figure 4A:
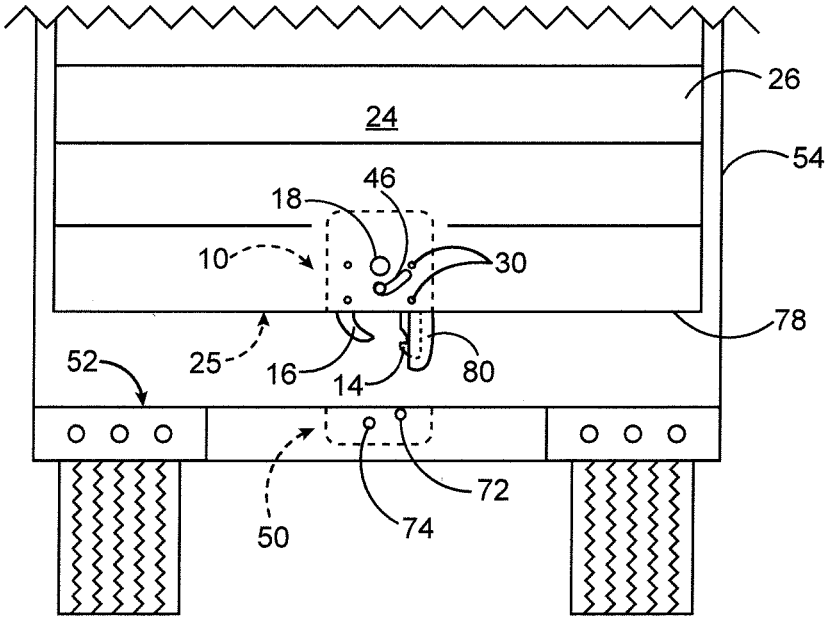
FIG. 4A is a semi-phantom view of the locking device shown attached to the interior surface of a roll-up door, the locking device being in the open position.
Figure 4B:
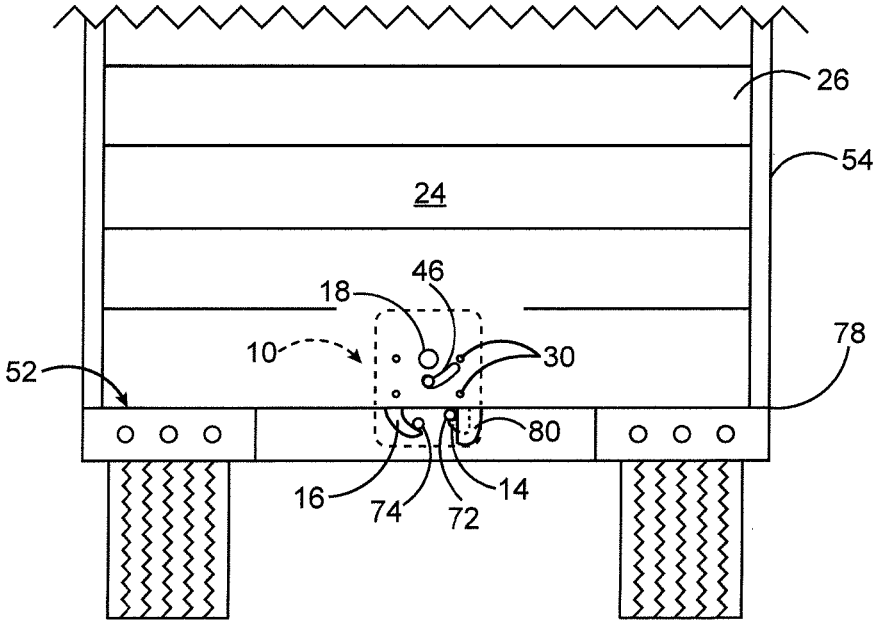
FIG. 4B is a semi-phantom view of the locking device shown attached to the interior surface of a roll-up door, the locking device being in the closed position.

FIG. 4A shows the locking device 10 attached to a roll-up door 24 on a cargo vehicle 54, this being a tractor-trailer. In this view the latch hook 16 of locking device 10 is in the disengaged position 71 as it would appear when door 24 is opened. As shown in FIG. 4A, the upper catch pin 72 is aligned to contact the beveled bottom portion 76 of the catch arm 14 causing it to pivot in an arc, which sets in motion the release of the latch hook 16 from a retained position as will be described further herein. When the latch hook 16 is released, it rotates downward and engages beneath lower catch pin 74 and locks in place, with the door 24 in the fully closed position as shown in FIG. 4B. With the door closed, the locking device 10 is hidden from access and the engagement upon dual catch pins 72, 74 effectively gathers up any slack between the bottom 78 of the roll-up door 24 and the loading deck 52. To reopen the locking device 10, the key lock 18 must be engaged and rotated to an open position to release the latch hook 16 from its locked position and the hand lever 46 is then rotated towards an open position, until the latch hook 16 is reset to its disengaged position 71. Once in its disengaged position 71 the latch hook 16 will be retained there despite any vibration or activity from operating the roll-up door 24.

As shown in FIG. 4B, when a roll-up door 24 with an attached locking device 10 is placed in the closed position, a shroud 80 protects catch arm 14. Shroud 80 partially encloses the catch arm 14 and protects it from damage due to contacting the casing 56 of catch assembly 50 as roll-up door 24 is closed. The shroud 80 prevents catch arm 14 from being snagged or bent due to operators harshly closing roll-up door 24, which can be a frequent occurrence during the working life of a roll-up door.

Figure 5A:
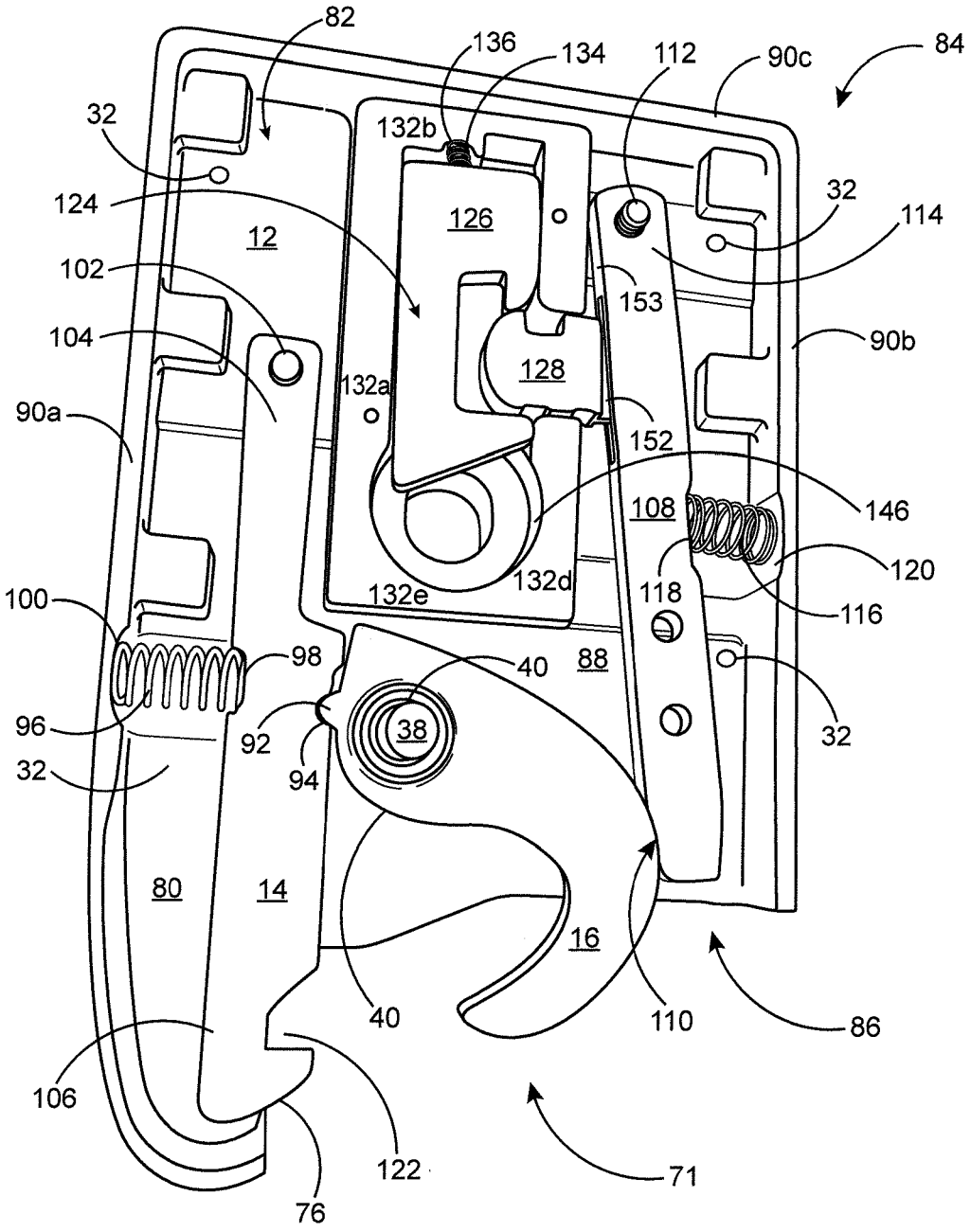
FIG. 5A is a plan view of the locking device, shown with the rear face of its housing removed so that the working parts are visible, this view indicating the latch hook in the disengaged position.

FIG. 5A illustrates the invention with the rear face 33 of housing 12 removed which shows the interior 82 of housing 12 with the working parts of the inventive locking device 10 exposed. The interior 82 of housing 12 is defined by an upper end 84, a lower end 86, and interior side 88 of front face 28 and sidewalls 90*a*, 90*b*, and 90*c*. In the view shown in FIG. 5A, the latch hook 16 is shown in its disengaged reset position 71, the way it might appear when locking device 10 is attached to an open roll-up door 24. Axle 38 extends through latch hook 16 and associated roller bearing 40 which seats in the bearing race 44 of the rear face 33 of housing 12 An additional roller bearing (not seen in this view) bears against latch hook 16 on its opposite side and seats in bearing race 42 of front face 28 of housing 12. The remaining working parts likewise appear as they should for the inventive locking device 10 being in the open position on an open roll-up door 24.

Figure 5B:
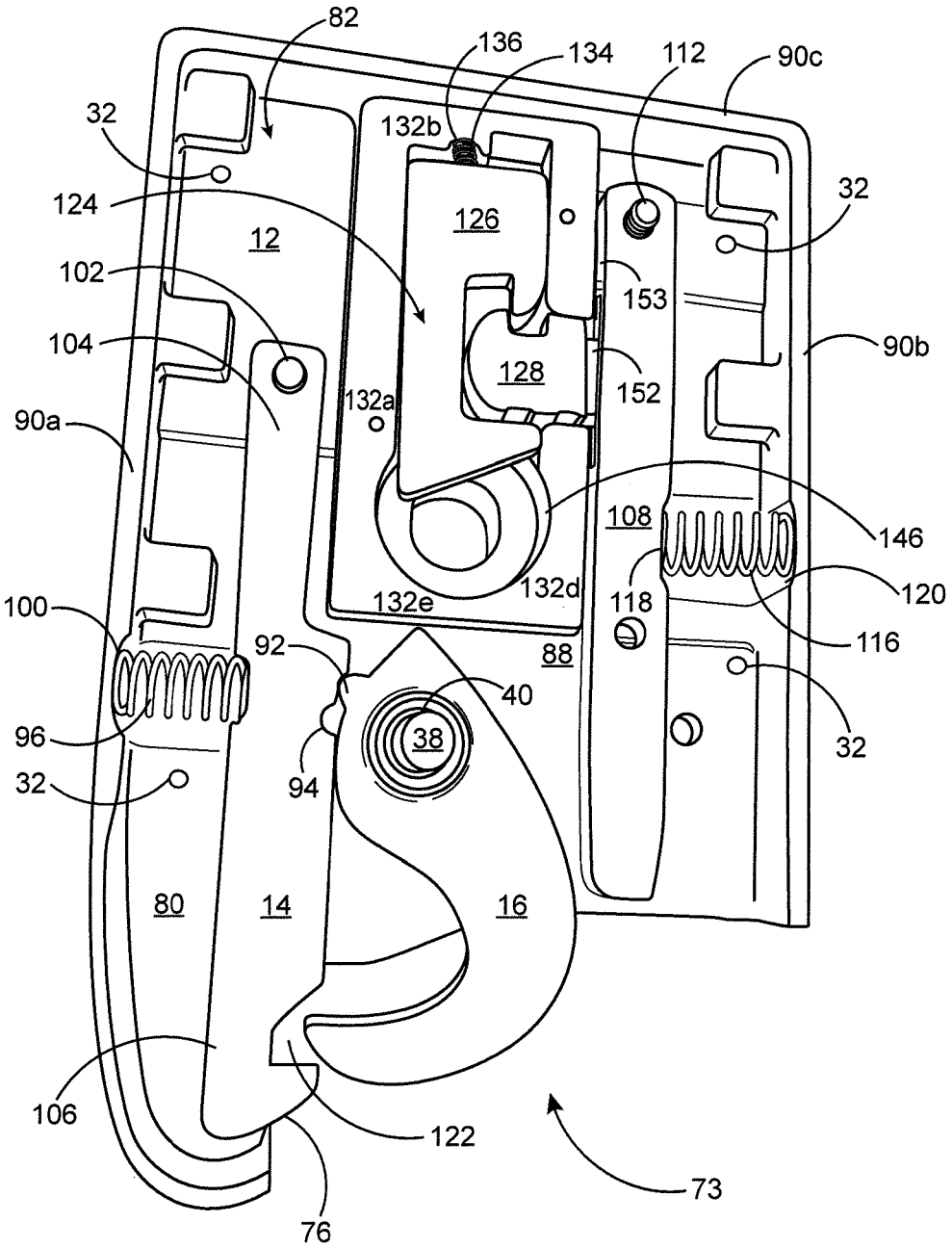
FIG. 5B is a plan view of the locking device, shown with the rear face of its housing removed so that the working parts are visible, this view indicating the latch hook in the engaged position.

Latch hook 16 is retained in its disengaged position 71 by latch hook keeper 92 which inserts into latch hook retaining notch 94 of catch arm 14. Catch arm 14 is biased by catch arm spring 96, which is retained in spring retaining notch 98 of catch arm 14 and an opposite retaining notch 100 imparted into sidewall 90*a* of housing 12. Catch arm 14 rotates on a pivot pin 102 attached to housing 12, the pivot pin 102 pivotally engaging the upper end 104 of catch arm 14. The lower end 106 of catch arm 14 is free to swing in an arc limited by the biasing force afforded by catch arm spring 96 and its contact against latch hook 16. Latch hook 16 in turn is biased against pushing arm 108 which places a pushing force against the outer curved side 110 of latch hook and urges latch hook to rotate towards catch arm 14 until achieving an engaged position 73 around lower catch pin 74 of the locking device 10 as shown in FIGS. 4B and 5B. Pushing arm 108 pivots at a pivot pin 112 on its upper end 114, pivot pin 112 being attached to housing 12.

FIG. 5B illustrates how the working parts of the inventive locking device appear when latch hook 16 is in an engaged position 73. When the beveled portion 76 of the lower end of catch arm 14 contacts the upper catch pin 72 of catch assembly 50, catch arm 14 pivots toward sidewall 90*a* and catch arm spring 96 is compressed. At the same time latch hook keeper 92 of latch hook 16 is freed of latch hook retaining notch 94 and pushing arm 108 forces latch hook 16 to rotate toward an engaged position 73 beneath lower catch pin 74 of catch assembly 50. Pushing arm 108 is biased by pushing arm spring 116 which is retained in a notch 118 in pushing arm 108 and a notch 120 in sidewall 90*b*. When roll-up door 24 is in the fully closed position, upper catch pin 72 is retained in upper catch pin notch 122 of catch arm 14. Retention is assured, as catch arm spring 96 biases catch arm 14 tightly against upper catch pin 72. Upper catch pin notch 122 is sized to flushly retain upper catch pin 72 therein with a minimal amount of play, thus insuring a tight engagement between the bottom 78 of a roll-up door 24 and the loading deck 52 of a cargo vehicle 54. Due to the tight engagement provided by the invention, forced breaches from inserting crowbars or jacks under a roll-up door mounting the invention are greatly prevented. It is preferable that catch arm 14 is constructed from hardened steel to resist wear, thus retaining a tight engagement with upper catch pin 72, despite repeated usage.

Figure 6A:
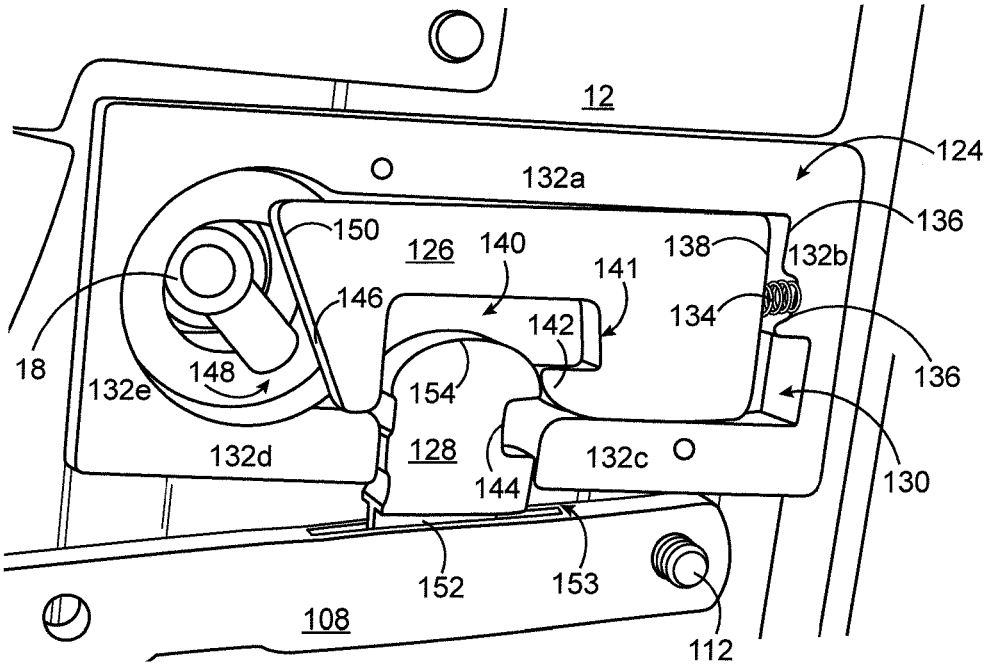
FIG. 6A is a close-up plan view of the locking assembly of the locking device as it would appear in the open position.
Figure 6B:
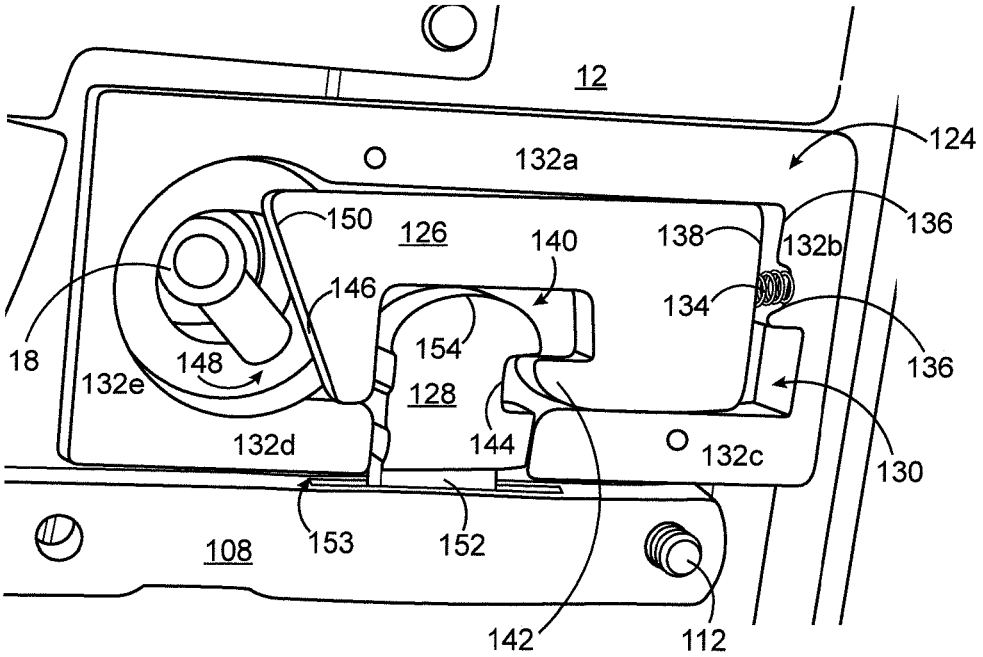
FIG. 6B is a close-up plan view of the locking assembly of the locking device as it would appear in the closed and locked position.

FIG. 6A shows a close up of the locking assembly 124 as it would appear in the open position with latch hook 16 in the disengaged position 71. FIG. 6B shows a similar close up of the locking assembly 124 as it would appear in the closed and locked position with door 24 closed and latch hook 16 in the engaged position 73. In conjunction with a key lock 18, (interior side of key lock shown here) the locking assembly 124 is comprised of a vertical hook member 126 and a hook retention member 128. A portion of the pushing arm 108 is also shown in this view to illustrate the engagement of the hook retention member 128 with the pushing arm 108. Vertical hook member 126 is retained in a retention chamber 130 of the interior side 88 of front face 28 of housing 12, retention chamber 130 being defined by sidewalls 132*a*, 132*b*, 132*c*, 132*d* and 132*e*. Vertical hook member 126 moves vertically within retention chamber 130 and movement is facilitated by vertical hook member spring 134 which biases vertical hook member 126 against sidewall 132*b*. Vertical hook member spring 134 is retained in a notch 136 in sidewall 132*b* and preferably, a cavity imparted into the top side 138 of vertical hook member 126. Vertical hook member 126 has an interior void 140 and a downwardly depending hook 142 adjacent the top 141 of interior void 140. Interior void 140 provides space in which hook retention member 128 can advance into to achieve a locked position. Hook retention member 128 advances and retreats between sidewalls 132*c* and 132*d* of retention chamber 130. Sidewalls 132*c* and 132*d* act to guide hook retention member 128 into its engagement and disengagement with downwardly depending hook 142. Hook retention member 128 has a notch 144 into which downwardly depending hook 142 advances to lock the locking assembly 124, and thereby lock the entire device 10 upon door 24 being closed. When door 24 is closed, latch hook 16 is engaged 73 around lower catch pin 74 and locked in its engaged position 73 by locking assembly 124. Beveled side 146 of vertical hook member 126 acts as a contacting surface for the lever 148 of the key lock 18 to act against. When the lever 148 pushes toward the lower end 150 of beveled side 146, the vertical hook member 126 travels vertically upward a sufficient distance to disengage downwardly depending hook 142 from notch 144 of hook retention member 128.

Hook retention member 128 pivotally engages with pushing arm 108 to allow sufficient range of motion for hook retention member 128 to horizontally advance into interior void 140 and engage with downwardly depending hook 142 (locked position show in FIG. 6B) and then horizontally travel in reverse to an unlocked position (See FIG. 6A) upon unlocking downwardly depending hook 142 from notch 144 with key lock 18. Hook retention member 128 includes a male end portion 152 which inserts into a side slot 153 on the side of pushing arm 108 wherein the two parts are joined by a pivot pin (not shown). Side slot 153 extends above and below male end portion 152 a sufficient distance to allow pushing arm 108 enough range of motion to pivot on its upper pivot pin 112 and impart its pushing force to latch hook 16. The smooth engagement and disengagement of downwardly depending hook 142 and hook retention member 128 is greatly enhanced by hook retention member having a rounded end 154 for hook 142 to travel against.

In operation, a cargo load placed into a vehicle using the inventive locking device would be locked as soon as the roll-up door on the vehicle is closed. As described above, merely dropping a roll-up door 24 into a closed position would cause the catch arm 14 to engage the upper catch pin 72 of the catch assembly 50, causing the latch hook 16 to be released from its retained position and pushed into an engaged position around lower catch pin 74 by pushing arm 108. At this point, a roll-up door 24 employing the invention 10 would be closed and locked tight and the user could apply a seal to the load, if desired. However, if it is desired to open the roll-up door 24, the user merely has to engage the key lock 18, rotate it to the open position and push the hand lever 46 toward the open position once key lock disengages vertical hook member 126 from hook retention member 128. When the hand lever 46 is engaged toward the open position, the latch hook 16 rotates until keeper 92 is engaged in retaining notch 94 in catch arm 14; this being the retained position. This rotation of latch hook 16 also pushes latch hook against pushing arm 108, thus biasing pushing arm against latch hook in the open position. When a user desires to close and lock the roll up door 24, he has to merely let the door drop and the striking of the catch arm 14 against the upper catch pin 72 will cause the working parts of the locking device 10 to adopt the closed and locked condition. The engagement of downwardly depending hook 142 into notch 144 of hook retention member 128 holds latch hook and its associated handle fast in the engaged position 73 around lower catch pin 74. The door 24 simply cannot be opened by force, short of extraordinary means. However, if even more security is desired, the hand lever 46 can be padlocked in a stationary position.

The locking device of the present invention can have applications outside of vehicle applications. For example, roll-up doors are applicable in many areas such as warehouse and storage units, to name some. Finally, although the description above contains much specificity, this should not be construed as limiting the scope of the invention, but as merely providing illustrations of some of the presently preferred embodiments of this invention. This invention may be altered and rearranged in numerous ways by one skilled in the art without departing from the coverage of any patent claims, which are supported by this specification.

The invention claimed is:

1. A locking device for a roll-up door on a cargo vehicle, the locking device comprising:

a catch assembly mounted in a loading deck of said cargo vehicle, said catch assembly further comprising a casing with an upper catch pin and a lower catch pin, said upper and lower catch pins mounted between a pair of sidewalls comprising said casing;

a housing mounted to said roll-up door on said cargo vehicle, said housing in communication with said catch assembly, said housing containing a plurality of working parts comprising:

a catch arm, said catch arm being biased by a catch arm spring;

a latch hook, said latch hook being retained in an open position by said catch arm while said roll-up door is in an open position, said latch hook contacting a pushing arm while said latch hook is being retained in said open position, said pushing arm being biased against said latch hook by a pushing arm spring;

a hook member being biased by a spring;

a hook retention member, said hook retention member for both engaging with and disengaging from, said hook member, said hook retention member being in communication with said pushing arm, said hook retention member being disengaged from said hook member when said latch hook is being retained in an open position by said catch arm;

a locking element operatively connected to said hook member;

wherein lowering said roll-up door to which said housing is attached first brings said catch arm into contact with said upper catch pin of said catch assembly causing said latch hook to release from its retention position on said catch arm, said latch hook being pushed into an engaged position around said lower catch pin by said pushing arm, said pushing arm further causing said hook retention member to engage said hook member and causing said locking, device to achieve a locked condition; and wherein said locked condition of said locking device is reset to an open condition by operating said locking element, disengaging said hook member from said hook retention member and moving said hook member back to its retained position in said catch arm.

2. The locking device for a roll-up door on a cargo vehicle as recited in claim 1, wherein said hook member further comprises a beveled side, said locking assembly incorporating a key lock, wherein said key lock comprises a rotatable lever, wherein upon said lever being rotated contacts said beveled side of said hook member thereby lifting said hook member a vertical distance and disengaging a downwardly depending hook of said hook member from said hook retention member.

3. The locking device for a roll-up door on a cargo vehicle as recited in claim 2, further comprising a handle in rotational communication with said latch hook, wherein upon disengaging said downwardly depending hook of said hook member from said hook retention member, said handle is rotated to move said latch hook back to its retained position on said catch arm, thus resetting the locking assembly from a locked condition to an open condition.

4. A locking device for a roll-up door, the locking device comprising: a catch assembly mounted flushly in a surface beneath said roll-up door, said catch assembly further comprising a casing with a first catch pin and a second catch pin, said first and second catch pins mounted between a pair of sidewalls comprising said casing, said first catch pin mounted at a different height in said casing than said second catch pin; a housing mounted to said roll-up door, said housing in communication with said catch assembly, said housing containing a plurality of working parts, comprising:

a catch arm, said catch arm being biased to pivot in an arc;

a latch hook, said latch hook being retained in an open position while said roll-up door to which said housing is attached is in an open position;

said latch hook communicating with a handle;

a driving assembly operatively connected to said latch hook;

a locking assembly operatively connected to said driving assembly; and a locking element operatively connected to said locking assembly;

wherein lowering said roll-up door to which said housing is attached first brings said catch arm into contact with said first catch pin causing said latch hook to be released from its retained open position, said latch hook moving into an engaged position around said second catch pin, said locking assembly holding said latch hook and said handle fast in the engaged position around said lower catch pin;

wherein said locking element operates said locking assembly to an unlocked position, moving said driving assembly and allowing rotation of said handle to cause rotation of said latch hook.

5. The locking device as recited in claim 4, wherein said locking assembly comprises a hook retention member and a hook member, said hook retention member for both engaging with and disengaging from, said hook member;

said driving assembly comprising a pushing arm;

wherein, said hook retention member being in communication with said pushing arm, said pushing arm being biased against said latch hook, wherein said release of said latch hook from said catch arm causes said hook member to engage said hook retention member causing said pushing arm to be held fast against said latch hook in the engaged position around said lower catch pin.

6. A locking device for a roll-up door on a cargo vehicle, the locking device comprising:

a catch assembly mounted in a loading deck of said cargo vehicle, said catch assembly further comprising a casing with an upper catch pin and a lower catch pin, said upper and lower catch pins mounted between a pair of sidewalls comprising said casing;

a housing mounted to said roll-up door on said cargo vehicle, said housing in communication with said catch assembly, said housing containing a plurality of working parts comprising:

a catch arm, said catch arm being biased by a catch arm spring, said catch arm being pivotally attached at its upper end to said housing;

a latch hook, said latch hook comprising a keeper, said keeper engaging a notch in said catch arm and being retained by said catch arm while said roll-up door is in an open position, said latch hook contacting a pushing arm, said pushing arm being biased against said latch hook by a pushing arm spring, said pushing arm providing a pushing force urging said latch hook rotationally in the direction of said catch arm;

a hook member, said hook member including a beveled side:

a hook retention member, said hook retention member for both engaging with and disengaging from said hook member, said hook retention member being in communication with said pushing arm, said hook retention member being disengaged from said hook member when said latch hook is being retained by said catch arm;

a handle in rotational communication with said latch hook;

a locking element operatively connected to said hook member;

wherein lowering said roll-up door mounting said housing first brings said catch arm into contact with said upper catch pin of said catch assembly causing said latch hook to release from its retention position on said catch arm, said latch hook being pushed toward said catch arm into an engaged position around said lower catch pin by said pushing arm; and wherein hook member engages said hook retention member when said latch hook engages said lower catch pin, effectively locking said locking device upon fully lowering said roll-up door mounting said locking device; and wherein said locking element operates said locking assembly to an unlocked position, moving said driving assembly and allowing rotation of said handle to cause rotation of said latch hook.

7. The locking device as recited in claim 6, wherein a lower end of said catch arm is protected by a shroud portion of said housing.

8. The locking device as recited in claim 7, wherein said lower end of said catch arm further comprises a notch, said notch engaging said upper catch pin.

9. The locking device as recited in claim 8, wherein said latch hook rotates on an axle coupled to a hand lever.

* * * * *